United States Patent [19]

Rosswag

[11] 4,372,831

[45] Feb. 8, 1983

[54] ELECTROLYTE SOLUTION FOR ELECTROPOLISHING

[75] Inventor: Helmut Rosswag, Aalen, Fed. Rep. of Germany

[73] Assignee: Schenk-Filterbau Gesellschaft mit beschränkter Haftung, Waldstetten, Fed. Rep. of Germany

[21] Appl. No.: 214,635

[22] Filed: Dec. 10, 1980

[30] Foreign Application Priority Data

Dec. 11, 1979 [DE] Fed. Rep. of Germany ..... 2949807

[51] Int. Cl.[3] ..... C25F 3/24

[52] U.S. Cl. ..... 204/129.8; 204/129.95

[58] Field of Search ..... 204/129.75, 129.8, 129.95, 204/129.9

[56] References Cited

U.S. PATENT DOCUMENTS

| | | | |
|---|---|---|---|
| 3,401,104 | 9/1968 | LaBoda | 204/129.95 |
| 3,528,896 | 9/1970 | Davidoff et al. | 204/129.95 X |
| 3,630,865 | 12/1971 | Minklei et al. | 204/129.95 X |

FOREIGN PATENT DOCUMENTS

| | | | |
|---|---|---|---|
| 55-11364 | 1/1980 | Japan | 204/129.95 |

*Primary Examiner*—Donald R. Valentine

*Attorney, Agent, or Firm*—Becker & Becker, Inc.

[57] ABSTRACT

An electrolyte solution for electropolishing metallic workpieces. The solution includes a base electrolyte, encompassing concentrated mineral acid such as phosphoric acid, sulfuric acid, nitric acid, perchloric acids, or mixtures thereof, and at least one additive in the form of polyphosphate added thereto for precluding etching of the metal surface of the workpiece to be polished.

7 Claims, No Drawings

ELECTROLYTE SOLUTION FOR ELECTROPOLISHING

The present invention relates to an electrolyte solution for electropolishing metallic workpieces; a base electrolyte is provided and comprises a concentrated mineral acid, such as phosphoric acid, sulfuric acid, nitric acid, perchloric acid, or mixtures thereof, with at least one additive added thereto for preventing etching of the metal surface of the workpiece to be polished.

The terms "electropolishing" and "electrochemical polishing" are understood to mean a method which leads to a smoothing and buffing or polishing of an originally rough and dull metal surface by "anodic removal with external current source". In this manner, it is possible in a relatively short time to provide a metallic workpiece with a smooth and shiny surface without utilizing surface-working machines, such as lapping or honing machines. With the present inventive method, particularly elevated surface regions, as for example those peaks located on the surface of a metallic workpiece, are removed more rapidly than the relatively smooth surface regions.

The theoretical background for electropolishing is set forth in the publication "Elektrochemisches Polieren" (Electrochemical Polishing) by J. Epelboin and M. Garreau, Zeitschrift Galvanotechnik 69, 1978, No. 6, Pages 494 et seq.

Electrolyte solutions for electropolishing metallic workpieces are known. These electrolyte solutions comprise in essence concentrated mineral acids such as, for example, sulfuric acid, phosphoric acid, chromic acid, or perchloric acid, or mixtures thereof. More or less large quantities or organic compounds, such as, for example, alcohols, amines, or carboxylic acids are added to this basic composition (basic electrolyte) for the purpose of avoiding etching of the workpiece surface.

It has been known for a long time that these known electrolyte solutions do not satisfy the requirements which have been set, since the mentioned organic additives do not assure the continuity of the polishing conditions. Chemical reactions (for example esterification) and/or electrochemical reactions (for example oxidation, reduction) lead to progressive changes of the composition of the electrolyte solution, which finally becomes unusable as a result thereof.

The increasing loss of polishing capability existing with the known electrolytes is based especially thereon that hydronium ions, $H_3O^+$, are released and etch the metal surface which is to be polished. This dissociation, and hence the generation of protons, is further reinforced by water supply thereto. For this reason, attempts were made to suppress as much as possible the formation of hydronium ions by adding organic compounds.

However, further disadvantages result by adding organic compounds, especially alcohol, because the acid reacts with the alcohol, accompanied by the formation of esters. Finally, organic compounds result, for example phosphoric acid-ester from phosphoric acid, which in turn to a great extent are responsible for the deficient polishing capability of the heretofore known electrolytes.

The conversion of known electrolytes into an unusable condition can occur in a relatively short time; disadvantageous is that the known electrolyte deterioration is definable only with difficulty during the time sequence of such occurrence, because with industrial utilization of the electrolyte, this leads to unweighability, which with modern quantity production can lead to considerable loss, breakdown, or stoppage of operations. Accordingly in practice it is absolutely necessary to continuously analyze the composition of an electrolyte solution being used. This analytic monitoring must occur in laboratories, and hence can only on very rare occasions be carried out with sufficient accuracy by the supplier of the electrolyte. Consequently, the monitoring of the electrolyte solution represents a very considerable cost factor.

Metaphosphoric acid is used in electrolyte for polishing copper with a polishing procedure disclosed by Swiss Patent 187439. This known procedure does not lead to satisfactory polishing results, since during the polishing procedure, a layer of difficult-to-dissolve copper metaphosphate forms upon the material to be polished, which precludes a uniform clearing of the workpiece surface to be polished.

It is furthermore known, for polishing nickel surfaces or polishing of non-iron alloys of nickel, to add metaphosphoric and pyrophosphoric acids to chromic acid-containing electrolytes (British Patent 610 019). This known method, however, is disadvantageous because of the chromate portions in the waste water, since the waste water can be decontaminated only by a costly waste water treatment.

The basic object of the present invention is to provide an electrolyte solution, the composition of which does not change even after long and frequent utilization, and the polishing capability of which also is not influenced during lengthy utilization, but rather is kept unchanged.

The electrolyte solution furthermore is to be such that no heavy or insoluble layer arises upon the material to be polished, and with which only a normal neutralization is necessary for cleaning or purifying the waste water.

With these objects in mind, the present invention is characterized primarily by providing polyphosphate as the additive to the base electrolyte solution.

Special examples of embodiments of the inventive electrolyte solution are set forth in the following paragraphs.

With workpieces of rust-free steel, the base electrolyte may comprise a mixture of sulfuric and phosphoric acids.

With workpieces of copper, phosphoric acid may be provided as the base electrolyte.

With the electrolyte solutions described, approximately 4 to 5 g/l polyphosphate may be added to the base electrolyte.

The electrolyte solution may comprise base electrolyte consisting of 800 ml/l of approximately 85% technical grade phosphoric acid, 100 ml/l of approximately 96% sulfuric acid, 100 ml/l water, 2.5 to 3 mg/l wetting agent, and 4-5 b/l polyphosphate. The polyphosphate may, for example, be sodium polyphosphate.

An optimum composition of an electrolyte solution is set forth as follows for electropolishing workpieces of rust-free, so called VA or austenitic steel (iron, chromium, nickel alloys):

| | |
|---|---|
| technical grade phosphoric acid - 85% | 800 ml/l |
| sulfuric acid - 96% | 100 ml/l |
| water | 100 ml/l |

-continued

| | |
|---|---|
| polyphosphate (n = 16), such as sodium polyphosphate | 4–5 g/l |
| wetting agent | 2.5–3 mg/l |

With respect to the polyphosphate, it should be noted that also with substitution values n=26 or n=36, surprisingly good results were obtained. A fluorinated wetting agent can, for example, be used as the wetting agent.

Excellent polishing results where achieved with the inventive electrolyte solution at the polishing conditions set forth subsequently herein. Especially, it was shown that the composition of the electrolyte solution remained substantially unchanged even after a very long time and frequent utilization thereof, so that an extensively uniform polishing quality of the electrolyte is assured.

The polishing requirements or conditions are, for example, as follows:

| | |
|---|---|
| (bath) temperature | 45–55° C. |
| current density | 8–20 A/dm$^2$ |
| duration or polishing time | 5–10 min |

A so-called "industrial gloss or shine" is obtained at the lower current density values with respect to the surface quality; a mirror gloss or shine is obtained in the upper current density range.

It has proven expedient for the electropolishing of copper to prepare the inventive electrolyte solution exclusively on the basis of phosphoric acid as the base electrolyte.

A further advantage of the inventive electrolyte solution consists in that the electrolyte is extensively odorless, and environmentally harmful additives, such as chromic acid, which previously had to be utilized, can now be eliminated. Since also the addition of alcohol is no longer necessary, all disadvantages brought about as a result of alcohol addition are eliminated, such as, for example, the occurrence of explosions in connection with the oxygen and hydrogen resulting during every electrolysis. The inventive electrolyte solution, accordingly, is in its entirety more favorable to the environment, and moreover particularly also because this electrolyte solution, compared with the heretofore known electrolytes, has the advantage of being odorless, environmentally harmful additives, for example chromic acid, as previously used, can be eliminated entirely.

A significant advantage of the present invention exists furthermore therein that as a consequence of the elimination of organic additives, such as alcohols, amines, carboxylic acids, etc., the previously necessary complicated analyses, with which mostly complex and costly separating procedures, such as chromatography, were necessary, can now be eliminated. The analysis of the inorganic mixture components according to the present invention is simple and straightforward.

The capability for simple analysis of the inventive electrolyte results therein that the electrolysis baths in industrial applications are considerably easier to monitor. This monitoring can be carried out by the consumer himself, and the complicated analysis in chemical laboratories can, as a rule, be eliminated.

The inventive electrolyte has not only a considerably greater shelf life or durability, but also qualitatively better polishing results are attainable therewith at otherwise identical conditions in comparison to the previously known electrolytes.

Finally, a further advantage consists therein that the slurry portion is smaller during utilization of the present inventive electrolyte than is the case with comparable electrolytes and comparable electrolysis conditions.

The present invention is, of course, in no way restricted to the specific disclosure of the specification and example, but also encompasses any modifications within the scope of the appended claims.

What I claim is:

1. An electrolyte solution for electropolishing metallic workpieces, said solution comprising in combination:

a base electrolyte of concentrated mineral acid as a strong acid medium;

at least one additive, in the form of a polyphosphate, added to said base electrolyte of concentrated mineral acid to prevent the concentrated mineral acid from etching of the metal surface of the workpiece which is to be polished; and a nominal water proportion therewith to attain only a predetermined degree of dissociation of the concentrated mineral acid though having no significant hydrolysis effect upon the polyphosphate thereby to assure that the electrolyte solution also remains unchanged even after very long time and frequent use so that an extensively uniform polishing quality is assured over a long time period while the electrolyte solution is extensively odorless and environmentally damaging additives are unnecessary.

2. An electrolyte solution in combination according to claim 1, in which said mineral acid for said base electrolyte is selected from the group consisting of phosphoric acid, sulfuric acid, nitric acid, perchloric acid, and mixtures thereof.

3. An electrolyte solution for electropolishing metallic workpieces, said solution comprising:

a base electrolyte of concentrated mineral acid; and at least one additive, in the form of a polyphosphate, added to said base electrolyte to prevent etching of the metal surface of the workpiece which is to be polished, said mineral acid for said base electrolyte being selected from the group consisting of phosphoric acid, sulfuric acid, nitric acid, perchloric acid, and mixtures thereof, and with workpieces of rust-free steel, said base electrolyte comprising a mixture of sulfuric acid and phosphoric acid.

4. An electrolyte solution for electropolishing metallic workpieces, said solution comprising:

a base electrolyte of concentrated mineral acid; and at least one additive, in the form of a polyphosphate, added to said base electrolyte to prevent etching of the metal surface of the workpiece which is to be polished, said mineral acid for said base electrolyte being selected from the group consisting of phosphoric acid, sulfuric acid, nitric acid, perchloric acid, and mixtures thereof, and with workpieces of copper, said base electrolyte comprising phosphoric acid.

5. An electrolyte solution according to claim 3 or 4, in which said additive comprises approximately 4 to 5 g polyphosphate per liter base electrolyte.

6. An electrolyte solution for electropolishing metallic workpieces, said solution comprising:

a base electrolyte of concentrated mineral acid; and at least one additive, in the form of a polyphosphate, added to said base electrolyte to prevent etching of the metal surface of the workpiece which is to be polished, said mineral acid for said base electrolyte being selected from the group consisting of phosphoric acid, sulfuric acid, nitric acid, perchloric acid, and mixtures thereof, and 800 ml/l of approximately 85% technical grade phosphoric acid, 100 ml/l of approximately 96% sulfuric acid, 100 ml/l water, 2.5 to 3 mg/l wetting agent, and 4 to 5 g/l polyphosphate.

7. An electrolyte solution according to claim 6, in which said polyphosphate is sodium polyphosphate.

* * * * *